US008446096B1

(12) United States Patent
Larraza et al.

(10) Patent No.: US 8,446,096 B1
(45) Date of Patent: May 21, 2013

(54) TERAHERTZ (THZ) REVERSE MICROMAGNETRON

(75) Inventors: Andres Larraza, Prunedale, CA (US); David M. Wolfe, Texarkana, TX (US); Jeffrey K. Catterlin, Salinas, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 386 days.

(21) Appl. No.: 12/894,815

(22) Filed: Sep. 30, 2010

Related U.S. Application Data

(60) Provisional application No. 61/248,301, filed on Oct. 2, 2009.

(51) Int. Cl.
*H01J 25/50* (2006.01)

(52) U.S. Cl.
USPC ..... 315/39.77; 315/39.51

(58) Field of Classification Search
USPC ..... 315/39.51, 39.77
See application file for complete search history.

(56) References Cited

U.S. PATENT DOCUMENTS 3,289,035 A * 11/1966 Drexler ..... 315/39.51
3,289,036 A * 11/1966 Bowers et al. ..... 315/39.53
3,290,548 A * 12/1966 Feulner ..... 315/39.51
3,479,556 A * 11/1969 Cook ..... 315/39.51
4,542,321 A * 9/1985 Singh et al. ..... 315/111.81
5,215,703 A * 6/1993 Bernardet ..... 376/114
5,676,873 A * 10/1997 Takase et al. ..... 219/761
5,805,025 A * 9/1998 Kwan et al. ..... 331/79
6,525,477 B2 * 2/2003 Small ..... 315/39.51
7,274,147 B2 9/2007 Shim et al.
7,714,513 B2 * 5/2010 Gorrell et al. ..... 315/5.39
7,728,397 B2 * 6/2010 Gorrell et al. ..... 257/429
7,935,930 B1 * 5/2011 Gorrell ..... 250/341.1
2010/0259273 A1 * 10/2010 Kawasaki et al. ..... 324/460

OTHER PUBLICATIONS

Siegel, P.N. "Terahertz technology," IEEE Transactions on Microwave Theory and Techniques.vol. 50, No. 3. pp. 910-928, Mar. 2002.

* cited by examiner

*Primary Examiner* — Thuy Vinh Tran
*Assistant Examiner* — Anthony Arpin
(74) *Attorney, Agent, or Firm* — Lisa A. Norris

(57) ABSTRACT

A THz reverse micromagnetron includes a MEMS-based reverse magnetron configuration in which the anode is located at the center of the magnetron surrounded by a cathode ring. Electrons move radially inward in the combined electric and magnetic cross-fields and can reach orbiting angular frequencies in the THz region, even with a magnetic field of the order of 1 T or less. The THz reverse micromagnetron is portable, operates at room temperature, and can be bright.

5 Claims, 4 Drawing Sheets

TERAHERTZ (THZ) REVERSE MICROMAGNETRON

CROSS-REFERENCE TO RELATED APPLICATIONS

This application claims the benefit of U.S. Provisional Patent Application No. 61/248,301, filed Oct. 2, 2009, which is hereby incorporated in its entirety by reference.

BACKGROUND OF THE INVENTION

1. Field of the Invention

The present invention relates generally to apparatus for producing terahertz (THz) radiation. More specifically, the present invention relates to a microelectromechanical system (MEMS)-based reverse magnetron apparatus for producing THz radiation.

2. Description of the Related Art

Most current sources of THz radiation are either very dim (e.g. nonlinear down conversion of optical lasers generate typically nanowatt (nW) outputs), very inefficient, or both (e.g. far infrared lasers have a power output in the THz region of few milliwatts (mW) but efficiencies of about 0.01%). Such conventional THz radiation sources are described in P. H. Siegal, "THz Technology: An Overview", *International Journal of High Speed Electronics and Systems*, Vol. 13, No. 2 (2003), which is herein incorporated by reference.

Quantum cascade lasers can be as bright as 50 mW, but they require cryogenic cooling. Unfortunately, other apparatus capable of generating intense sources of THz radiation are uniformly bulky and difficult to transport (e.g. free electron laser and synchrotron radiation sources).

Magnetrons have featured prominently in the production of intense microwave radiation, as described in, for example, Victor L. Granatstein and Igor Alexeff, ed., *High Power Microwave Sources*, Boston: Artech, 1987, herein incorporated by reference. While the external configurations of different conventional magnetrons vary, the basic internal structures are generally the same—these include a central filament/cathode, an outside anode cylinder concentric to the cathode, an antenna, and magnets. The motion of electrons is due to the combined influence of cross electric (radial) and magnetic (axial) fields. In this case, the radiation frequency is near to the cyclotron frequency and amplification is achieved as the whirling cloud of electrons, influenced by the high voltage and the strong magnetic field, forms a rotating pattern that resembles the spokes in a spinning wheel and interacts with an alternating current flow in the resonant cavities configured at the inner surface of the anode. In order to achieve radiation frequencies in the THz region, unrealistically large magnetic fields, of several Tesla, are required.

U.S. Pat. No. 7,274,147, issued to Shim et al., describes a MEMS-based apparatus, using a miniaturized magnetron and claims to generate THz radiation. In Shim et al. an anode block concentrically surrounds a cathode unit and the electrons spiral outward. The large magnetic field requirements for operation of this device in the THz region make this apparatus impractical.

SUMMARY OF THE INVENTION

In accordance with one embodiment, a terahertz (THz) reverse micromagnetron includes: a cathode ring having a central void; and an anode post centrally located within the central void of the cathode ring, wherein application of an applied voltage between the cathode ring and the anode post causes field-emitted electrons to be accelerated radially inwards producing radiation.

In accordance with another embodiment, a THz reverse micromagnetron chip includes a plurality of terahertz (THz) reverse micromagnetrons, each THz reverse micromagnetron including: a cathode ring having a central void; and an anode post centrally located within the central void of the cathode ring, wherein application of an applied voltage between the cathode ring and the anode post causes field-emitted electrons to be accelerated radially inwards producing radiation. In one embodiment, the chip has a width of about 1 cm and a length of about 1 cm and includes several hundred of the THz reverse micromagnetrons. In one embodiment, the chip includes a conductive substrate electrically connecting each anode post of the plurality of THz reverse micromagnetrons. In one embodiment, the chip includes a void centrally located on the chip. In one embodiment, this void has an area of at least ⅓ of a total surface area of the chip.

In accordance with a further embodiment, a terahertz (THz) reverse micromagnetron assembly includes: a chip mount, the chip mount adapted to mount a chip; a chip mounted on the chip mount, the chip including: a plurality of terahertz (THz) reverse micromagnetrons, each THz reverse micromagnetron including: a cathode ring having a central void; and an anode post centrally located within the central void of the cathode ring wherein the chip has a void centrally located on the chip; a a magnet assembly having a first pole and a second pole arranged in a push-pull configuration, wherein each of the first pole and the second pole has a central void, and wherein the chip mount is positioned between the first pole and the second pole of the magnet assembly; a first reflecting mirror and a second reflecting mirror, wherein the first reflecting mirror and the second reflecting mirror form a confocal cavity having a confocal point, further wherein the chip is positioned in the confocal plane of the confocal cavity; and wherein application of an applied voltage between the cathode ring and the anode post causes field-emitted electrons to be accelerated radially inwards producing radiation.

Embodiments in accordance with the invention are best understood by reference to the following detailed description when read in conjunction with the accompanying drawings.

DETAILED DESCRIPTION OF THE INVENTION

Broadly viewed, embodiments in accordance with the terahertz (THz) reverse micromagnetron include a centrally located anode surrounded by a cathode ring, herein termed a "reverse-magnetron" configuration. When power is applied, electrons move radially inward in the combined electric and magnetic cross-fields and can reach orbiting angular frequencies in the THz region, even with a magnetic field of the order of 1 T or less. The terahertz reverse micromagnetron is portable, operates at room temperature, and can be bright. It has applicability in imaging and other applications where intense sources of radiation are needed, such as in the areas of improvised explosive device (IED) detection, airport security, imaging for medical, pharmaceutical, and semiconductor applications, and spectroscopy for large chem-bio molecules.

Figure 1A:
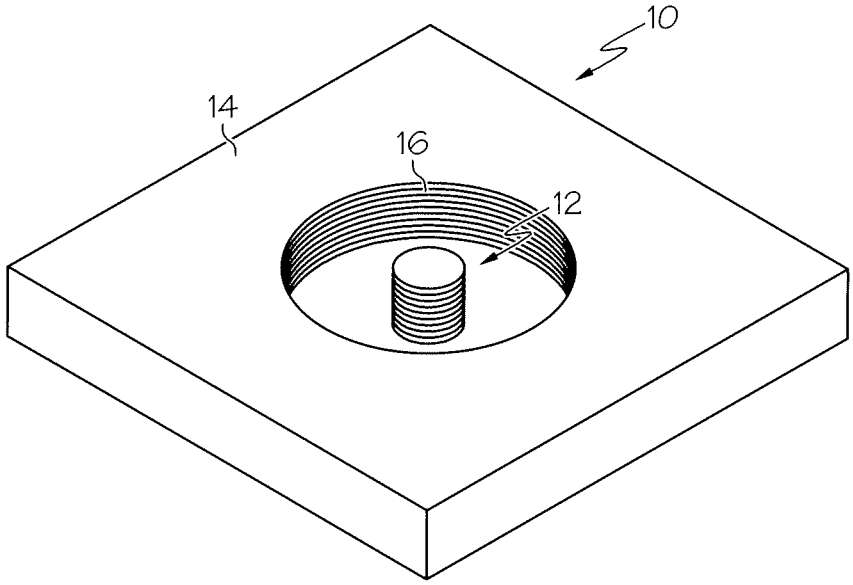
FIG. 1A is a perspective view of a terahertz reverse micromagnetron in accordance with one embodiment.
Figure 1B:
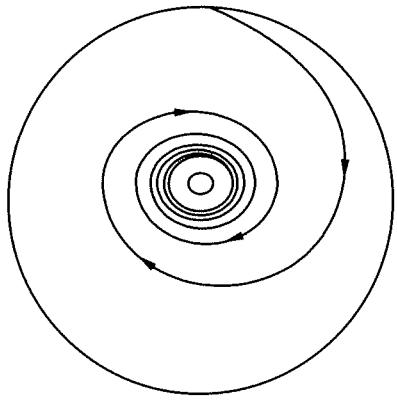
FIG. 1B is a schematic diagram showing the electron path in the presence of a radial electric field and an axial magnetic field in the terahertz reverse micromagnetron of FIG. 1A in accordance with one embodiment.

Referring to FIG. 1A, in one embodiment, a THz reverse micromagnetron 10 includes an anode post 12 coaxially disposed within a cathode ring 14. More specifically, anode post 12 is centrally located within an interior void of cathode ring 14. In one embodiment, cathode ring 14 includes scalloping 16 on the interior wall to facilitate generation of field-emitted electrons. As shown in FIG. 1B, the electron path of the field-emitted electrons is radially inward, thereby permitting orbiting angular frequencies in the THz region. In one embodiment, THz reverse micromagnetron 10 can be formed as a microelectromechanical system (MEMS)-based device as further described herein.

Figure 2A:
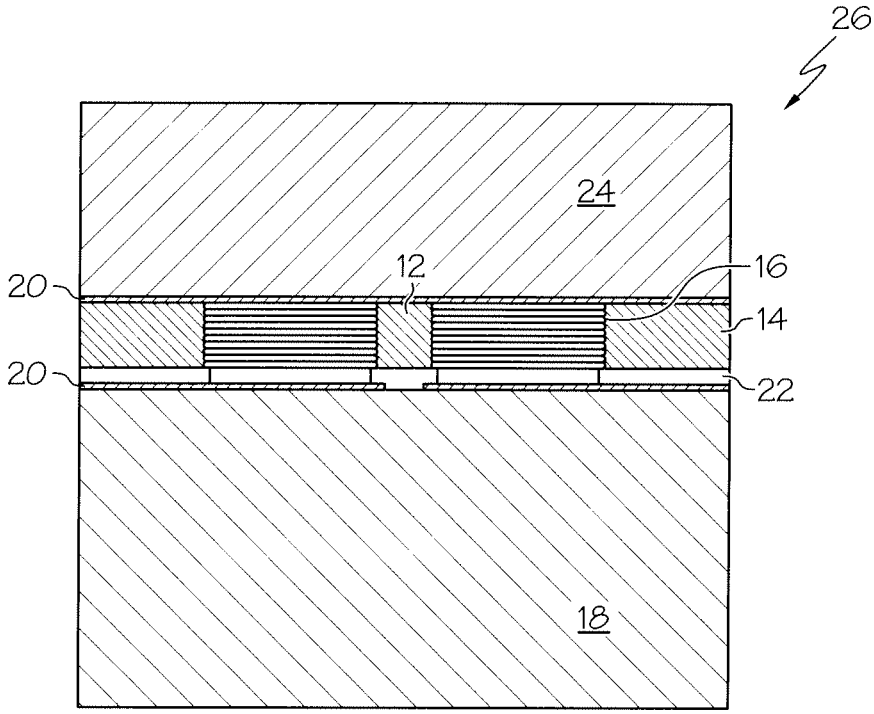
FIG. 2A is a cross-sectional view of a single device terahertz reverse micromagnetron in accordance with one embodiment.

FIG. 2A is a cross-sectional view of a single terahertz reverse micromagnetron 26 in accordance with one embodiment. In one embodiment, THz reverse micromagnetron 26 includes anode post 12 centrally located within the void formed by cathode ring 14. In the present embodiment, the interior wall of cathode ring 14 includes scalloping 16.

In one embodiment, anode post 12 is conductively connected to a conductive substrate 18 and is electrically insulated from cathode ring 14 by a first insulating layer 20. In one embodiment, a conductive bonding material 22 is disposed between cathode ring 14 and insulating layer 20. In one embodiment, conductive bonding material 22 is a few microns thick and the thickness of anode post 12 and cathode ring 14 is about 100 μm. In one embodiment, terahertz reverse micromagnetron 26 further includes a top substrate 24 that hermetically seals the THz reverse micromagnetron 26 for vacuum packaging. In one embodiment, a second insulating layer 20 is disposed between top substrate 24 and the underlying structures. In one embodiment, first insulating layer 20 and second insulating layer 20 can be formed of the same material. In some embodiments, first insulating layer 20 and second insulating layer 20 can be formed of different materials.

In various embodiments, the dimensions of cathode ring 14 can vary according to the radiation frequency. In embodiment, the diameter of cathode ring 14 is at or about 100 μm and the diameter of anode post 12 is at or about 10 μm. Herein the diameter of cathode ring 14 refers to the diameter of the void within which anode post 12 is located. Herein the diameter of anode post 12 is the outer diameter of anode post 12. An applied voltage between cathode ring 14 and anode post 12 can yield field-emitted electrons which, in turn, can be accelerated radially inwards. Scalloping 16, formed on the inside surface of cathode ring 14, can facilitate generation of the field-emitted electrons.

Figure 2B:
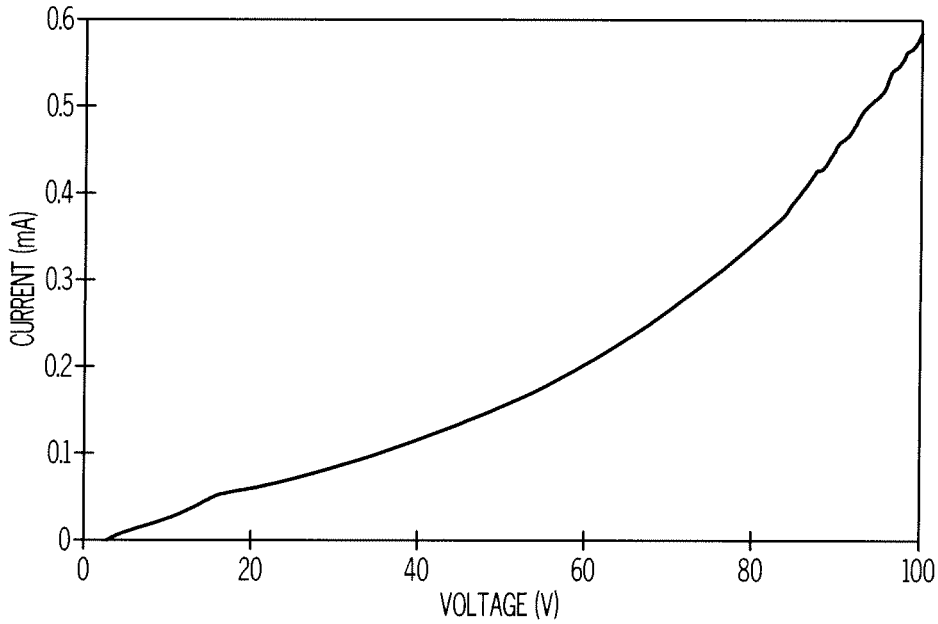
FIG. 2B is a graph showing the electric characterization of the terahertz reverse micromagnetron of FIG. 2A, in the absence of a magnetic field in accordance with one embodiment.

FIG. 2B is a graph showing the electric characterization of the terahertz reverse micromagnetron of FIG. 2A in the absence of a magnetic field in accordance with one embodiment. More particularly, FIG. 2B shows an electric characterization (I-V curve) with no external magnetic field. The nonzero electric current is due to field-emitted electrons arriving at the anode. In the presence of an axial magnetic field, the field-emitted electrons spiral into cathode ring 14 as shown in FIG. 1B.

In one embodiment, the radiation output can be enhanced by utilizing an array of THz reverse micromagnetrons. FIG. 3A is a schematic view of a chip 28 containing a plurality of terahertz reverse micromagnetrons 26 in accordance with one embodiment. In one embodiment, chip 28 is a 1 cm×1 cm chip and includes a plurality of THz reverse micromagnetrons 26, illustrated as the grid lined portion of chip 28.

Referring to FIGS. 2A and 3A together, in one embodiment, conductive substrate 18 serves as a common electric plane for all anode posts 12 of the plurality of THz reverse micromagnetrons 26, providing a larger surface for heat load management at anode posts 12. In one embodiment, a central void 32 is centrally formed in chip 28. In one embodiment, central void 32 has an area of at least ⅙ of the total surface area of chip 28. In one embodiment, a strip perimeter 30 around the outer edge of chip 28 can contain electrodes (not shown) that electrically connect to cathode rings 14 of each THz reverse micromagnetrons 26, to conductive substrate 18, or both. In one embodiment, the electrodes are suitable for current loads at or about 5 amps.

Figure 3B:
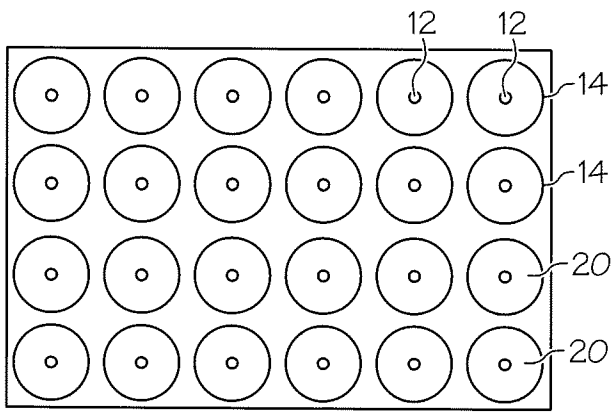
FIG. 3B is a close-up view of the anode posts and cathode rings networks of FIG. 3A in accordance with one embodiment.
Figure 3A:
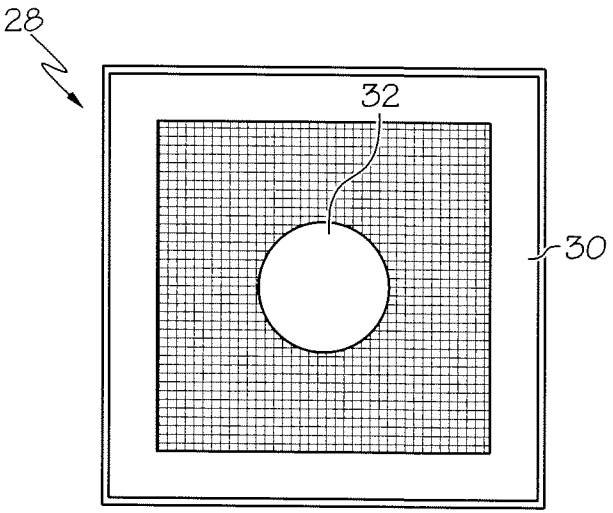
FIG. 3A is a schematic view of a chip containing a plurality of the terahertz reverse micromagnetrons of FIG. 2A in accordance with one embodiment.

FIG. 3B is a close-up view of a portion of anode posts 12 and cathode rings 14 on chip 28 in accordance with one embodiment. In one embodiment, cathode rings 14 are all electrically interconnected, and anode posts 12 and cathode rings 14 are electrically isolated by insulating layer 20. As further discussed in greater detail below, a substantial power enhancement can be achieved by positioning chip 28 in a large confocal cavity with all THZ reverse micromagnetrons 26 coupled electromagnetically through cavity mirrors.

Figure 4:
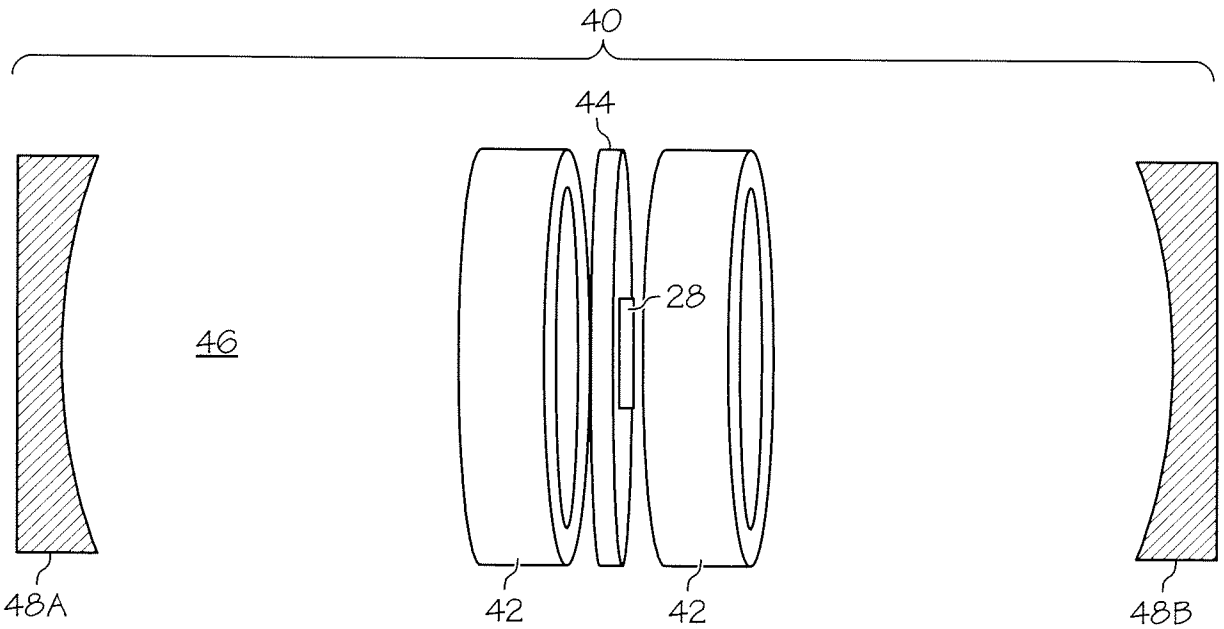
FIG. 4 is a schematic view of a terahertz reverse micromagnetron assembly including a chip having a plurality of the terahertz reverse micromagnetrons positioned within a confocal cavity in accordance with one embodiment.

FIG. 4 is a schematic view of a THz reverse micromagnetron assembly 40 including a chip 28 having a plurality of the terahertz reverse micromagnetrons 26 positioned in a confocal cavity in accordance with one embodiment. In one embodiment, a confocal cavity 46 is formed between two reflecting mirrors, a first mirror 48A and a second mirror 48B. In one embodiment, one of the two mirrors 48A or 48B has high reflectance, while the other has finite transmittance.

Referring now to FIGS. 3A and 4 together, in one embodiment, chip 28 is mounted on a chip mount 44 at the focal plane of confocal cavity 46. In one embodiment, chip mount 44 is positioned between two poles of a magnet assembly 42 in a push-pull configuration. In this push-pull configuration magnet assembly 42 provides the appropriate uniform magnetic field in the region of chip 28. As illustrated, each pole of magnet assembly 42 has a centrally located void. More particularly, a first pole and a second pole of magnet assembly 42 each have a centrally located void.

In one embodiment, a through-hole is formed by the central voids in the two poles of magnet assembly 42 and central void 32 in chip 28. This through-hole allows radiation to bounce back and forth in confocal cavity 46 between first mirror 48A and second mirror 48B. In this embodiment, electromagnetic coupling among all THz reverse micromagnetrons 26 of chip 28 can be established, encouraging coherent radiation among all the THz reverse micromagnetrons 26.

In one embodiment THz reverse micromagnetron assembly 40 has a Q of at least 100,000 and a magnetic field of at most 1 T. In one embodiment, because the size of each THz reverse magnetron apparatus 26 is less than 200 μm, i.e., less than a wavelength of THz light, there exists the possibility of intrinsically coherent radiation due to the natural spatial bunching of the electrons.

In one embodiment, the theoretical DC power requirements for THz reverse micromagnetron assembly 40 ranges from about 15 W to about 100 W. With the confocal cavity configurations shown in FIG. 4, the range of Q values (at 1 THz) is from $10^6$ to $10^7$. Because there can be several hundred THz reverse micromagnetrons 26 in chip 28, and if all couple through a feedback mechanism, then there will be a substantial power enhancement. Thus, even assuming a 1% efficiency, the THz power can be from about 150 mW to about 1 W. This is in contrast to conventional quantum cascade lasers in the THz which yield a maximum of about 20 mW and which need to be cooled at liquid He temperatures, with efficiencies of the order of 0.01%.

In one embodiment, an external solenoid can be utilized to provide frequency tunability of THz reverse micromagnetron assembly 40. In a further embodiment, a cell containing a liquid (e.g., benzene) can be inserted, whereby metastable rotational states with transition frequencies in the THz can be excited, acting as an amplifier.

This disclosure provides exemplary embodiments of the invention. The scope of the invention is not limited by these exemplary embodiments. Those of skill in the art can understand that embodiments in accordance with the invention can also be scaled up or down in size to accommodate various applications. Numerous variations, whether explicitly provided for by the specification or implied by the specification or not, may be implemented by one of skill in the art in view of this disclosure.

We claim:

1. A terahertz (THz) reverse micromagnetron assembly comprising:

a chip mount, the chip mount adapted to mount a chip;

a chip mounted on the chip mount, the chip comprising:

a plurality of terahertz (THz) reverse micromagnetrons, each THz reverse micromagnetron comprising:

a cathode ring having a central void; and an anode post centrally located within the central void of the cathode ring wherein the chip has a void centrally located on the chip;

a magnet assembly having a first pole and a second pole arranged in a push-pull configuration, wherein each of the first pole and the second pole has a central void, and wherein the chip mount is positioned between the first pole and the second pole of the magnet assembly;

a first reflecting mirror and a second reflecting mirror, wherein the first reflecting mirror and the second reflecting mirror form a confocal cavity having a confocal point, further wherein the chip is positioned in the confocal plane of the confocal cavity; and wherein application of an applied voltage between the cathode ring and the anode post causes field-emitted electrons to be accelerated radially inwards producing radiation.

2. The terahertz (THz) reverse micromagnetron assembly of claim 1, wherein the central voids of the first pole and the second pole of the magnet assembly and the void on the chip form a through-hole to allow radiation to bounce back and forth in the confocal cavity between the first mirror and the second mirror.

3. The terahertz (THz) reverse micromagnetron assembly of claim 2, wherein each of the plurality of terahertz reverse micromagnetrons on the chip are electromagnetically coupled to permit feedback.

4. The terahertz (THz) reverse micromagnetron assembly of claim 3 further comprising:

a cell containing a liquid whereby metastable rotational states with transition frequencies in the THz can be excited, acting as an amplifier.

5. The terahertz (THz) reverse micromagnetron assembly of claim 3 further comprising:

an external solenoid to provide frequency tunability.

* * * * *